US005174618A

United States Patent [19]

Kropf

[11] Patent Number: 5,174,618

[45] Date of Patent: Dec. 29, 1992

[54] DOOR LATCH ASSEMBLY

[75] Inventor: Keith E. Kropf, Newton, Iowa

[73] Assignee: Maytag Corporation, Newton, Iowa

[21] Appl. No.: 806,011

[22] Filed: Dec. 9, 1991

[51] Int. Cl.[5] ..... E05C 19/06

[52] U.S. Cl. ..... 292/254; 292/DIG. 69

[58] Field of Search ..... 292/254, 341.17, 341.15, 292/DIG. 69, 228

[56] References Cited

U.S. PATENT DOCUMENTS

| | | | |
|---|---|---|---|
| 2,618,282 | 11/1952 | Stanitz et al. | 292/DIG. 69 |
| 2,692,602 | 10/1954 | Stanitz et al. | 292/DIG. 69 |
| 3,011,816 | 12/1961 | Van Noord | 292/DIG. 69 |
| 3,091,675 | 5/1963 | Sholtes | 292/DIG. 69 |
| 3,229,061 | 12/1963 | Harroff . | |
| 3,328,062 | 6/1967 | Geiger . | |
| 3,415,961 | 12/1968 | Barnard . | |
| 3,841,677 | 10/1974 | Guth . | |
| 3,912,891 | 10/1975 | Mercer et al. | 292/DIG. 69 |
| 3,924,085 | 12/1975 | Stone . | |
| 3,997,201 | 12/1976 | DeSchaaf . | |
| 4,109,950 | 8/1978 | Amdal . | |
| 4,186,287 | 1/1980 | Scott . | |
| 4,745,250 | 5/1988 | Mayo | 292/DIG. 69 |
| 4,750,503 | 6/1988 | Noren . | |
| 4,776,620 | 10/1988 | Marks . | |
| 4,932,707 | 6/1990 | Ekstran | 292/254 |

*Primary Examiner*—Eric K. Nicholson
*Attorney, Agent, or Firm*—Zarley, McKee, Thomte, Voorhees & Sease

[57] ABSTRACT

An appliance door latch assembly includes a strike member pivotally mounted to the door frame of an appliance. A spring yieldably urges the strike member to a latch position, and the strike member is movable against the bias of the spring from the latch position. A fixed bolt is mounted to the appliance door and adapted to engage the strike member and urge the strike member upwardly to its unlatch position and then downwardly to its latch position where it engages a latching shoulder on the fixed bolt. In moving from its unlatch position to its latch position, the strike member also engages a moveable handle on the door and forces the moveable handle into engagement with plungers of switches so as to cause the switches to be moved to their closed position only when the door is latched.

30 Claims, 7 Drawing Sheets

DOOR LATCH ASSEMBLY

BACKGROUND OF THE INVENTION

This invention relates to a door latch assembly, and particularly to a door latch assembly for use with a dishwashing machine.

Dishwashing machines conventionally include a tub forming an interior washing chamber. A door opening is provided in the tub, and a door is attached to the door opening and hinged at its lower edge for movement between open and closed positions. The upper edge of the door latches to the door frame for holding the door in sealed closure over the door opening.

The door of the dishwasher contains a control panel adjacent its upper end, and within this control panel is electrical circuitry for controlling the operation of the dishwasher. For proper operation the dishwasher should be capable of being placed in an operable condition only during the time that the door is latched, but in an inoperable condition at all times when the door is unlatched. Therefore, the latch assembly should be capable of simultaneously latching the door and placing the control circuitry for the dishwasher in an operable state. When the latch assembly is unlatched, the latch assembly should at the same time disconnect the control circuitry so that the dishwasher will stop operating. Stopping the operation of the machine when the door is unlatched is important to prevent hot water from being sprayed or splashed upon the person opening the door.

Certain problems have been encountered in developing satisfactory door latch assemblies for dishwashers. One difficulty is designing a door latch assembly which occupies a minimum of space so that it can be easily mounted within the interior panels of the door. Another problem is the need for a door latch assembly which provides a positive reliable latching mechanism, while at the same time providing a positive reliable means for connecting and disconnecting the power system of the dishwasher.

One example of a prior latch assembly is shown in U.S. Pat. No. 4,776,620. This device utilizes a cantilevered leaf spring which is attached at one end to the door frame. The leaf spring engages a fixed bolt mounted within the dishwasher door and deflects while camming over the fixed bolt to the latch position. In the latch position, the cantilever spring also engages switches which actuate the power system for the dishwasher when the door is latched. A latch handle on the door is operable to disengage the latch and simultaneously disengage the latch from the switches so that the switches are rendered in an open position, thereby deactuating the power system of the dishwasher.

One disadvantage of the cantilever spring latch mechanism is the variable spring constant inherent in this type of spring. The force exerted on the end of the spring is variable during its travel. Consequently, this type of latch requires a switch which can be placed in a closed condition in response to a lower spring force. Typically, switches capable of responding to lower forces also must be of a reduced power rating.

Another disadvantage of the device shown in U.S. Pat. No. 4,776,620 is that this latch includes a pivoting handle which requires more space front to back and which affects the handle force and travel. It is desirable to provide a more compact handle which slides in a linear direction and which has a one-to-one force and distance relationship.

SUMMARY OF THE INVENTION

Therefore, a primary object of the present invention is the provision of an improved door latch assembly, particularly a door latch assembly for a dishwashing machine.

A further object of the present invention is the provision of an improved door latch assembly which utilizes a spring mounted, pivoting strike member.

A further object of the present invention is the provision of an improved door latch assembly which includes a spring mounted strike member which has an approximately constant force applied to it throughout its distance of travel between its latch and unlatch position.

A further object of the present invention is the provision of an improved door latch assembly which uses a minimum of space within the panels of the doors.

A further object of the present invention is the provision of an improved door latch assembly which is capable of providing a greater force to the end of the strike member than in prior devices.

A further object of the present invention is the provision of an improved door latch assembly which utilizes a sliding handle as opposed to a pivoting handle and which provides a one-to-one force and distance relationship.

A further object of the present invention is the provision of an improved door latch assembly which is economical to manufacture, durable in use, and efficient in operation.

The present invention achieves these objects with an improved door latch assembly for use with an appliance having a cabinet, a door opening provided in the cabinet, and a door hinged to the cabinet and moveable from a closed position in covering relationship over the door to an open position. In one embodiment of the invention a strike member is pivotally mounted to the door frame and is adapted to engage a fixed bolt on the door when the door is in its closed position. The strike member is spring mounted by means of a torsion spring so that it pivots between a latch position and an unlatch position. The torsion spring urges the strike member toward its latch position.

In a second embodiment of the invention, the strike member is integral with the torsion spring and is formed from a U-shaped extension of the torsion spring. This U-shaped portion of the torsion spring is adapted to engage the fixed bolt of the door.

The fixed bolt is mounted to the door and includes a ramp surface and a latching shoulder. As the door is closed, the strike member engages the ramp surface of the bolt and rides over the bolt and is forced downwardly by the torsion spring into engagement with the latching shoulder on the bolt. This latches the door positively in its closed position.

A pair of electrical switches are mounted within the panels of the door and are connected to the power system for the dishwasher. The switches are normally in an open position which prevents actuation of the power system for the dishwasher. However, they include moveable switch members which are spring mounted and which can be yieldably moved to change each switch from an open position to a closed position so as to actuate the power system of the dishwasher.

A door handle is slidably mounted within the panels of the door and is engagable with the switch members.

The door handle is vertically slidable from a first position, wherein the switch members are permitted to remain in their open position to a second position, wherein the switch members are depressed and held in their closed position.

The positioning of the door handle is such that the door handle is engaged by the strike member during the time that the strike member cams over the fixed bolt and moves downwardly into engagement with the latching shoulder of the bolt. As the strike member moves downwardly, it engages the handle and forces the handle downwardly, thereby causing the switch members to be moved into their closed position. This permits actuation of the power system for the dishwasher only when the door is in its latch position.

When the door is opened, the handle is lifted upwardly, thereby disengaging the strike member from the latching shoulder of the fixed bolt and simultaneously permitting the spring mounted switch members to move upwardly and place the switches in an open position. This deactuates the power system for the dishwasher and prevents the dishwasher from continuing to operate when the door is unlatched.

The use of a pivotally mounted strike member and the use of a torsion spring for urging the strike member to its latch position results in a substantially constant force being applied to the end of the strike member throughout its movement from its unlatch to its latch position. Furthermore, it is possible to apply a greater force of at least two pounds to the strike member by the use of this arrangement.

The ability to bring a greater force to bear at the end of the strike member also permits the use of switches of higher power ratings. For example, with a force which exceeds two pounds, it is possible to use switches which have 25 amp ratings.

The use of a sliding handle, as opposed to a pivoting handle used in prior devices, permits the more efficient use of space between the panels of the door and also affects the relationship of the force and travel relationship needed for moving the handle to disengage the latch. There is a one-to-one force and distance relationship with the use of this sliding handle.

DETAILED DESCRIPTION OF THE PREFERRED EMBODIMENT

Figure 1:
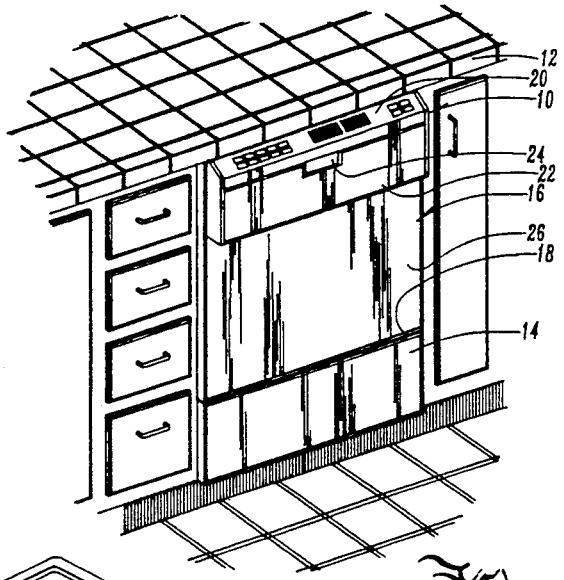
FIG. 1 is a perspective view of a dishwasher mounted beneath a counter.

Referring to the drawings, the numeral 10 generally designates a dishwasher which is installed beneath a counter 12. Dishwasher 10 includes a removable access door 14 and a hinged door 16 which is hinged adjacent its lower edge 18 for pivotal movement about a horizontal axis. The upper edge 20 of door 16 includes a control panel 22 having a handle opening 24 therein. Door 16 includes an outer door panel 26 and an inner door panel 28 which are fitted together to provide a sealed insulation compartment 29 therein. Extending around the perimeter of the inner panel 28 is a sealing rim 30.

Control panel 22 forms a controller compartment 32 in which are housed numerous electrical components for controlling the power system and the operation of the dishwasher. The door 16 is adapted to close a door opening 34 (FIGS. 3-5) which is framed by a door frame 36. In cross section door frame 36 includes a vertical flange 38, an inwardly extending flange 40, and a channel 42 which surrounds the door opening 34. Fitted within channel 42 is an elastomeric seal 44 which is adapted to be engaged by sealing rim 30 (FIGS. 3 and 4) when the door is in its closed position.

Figure 3:
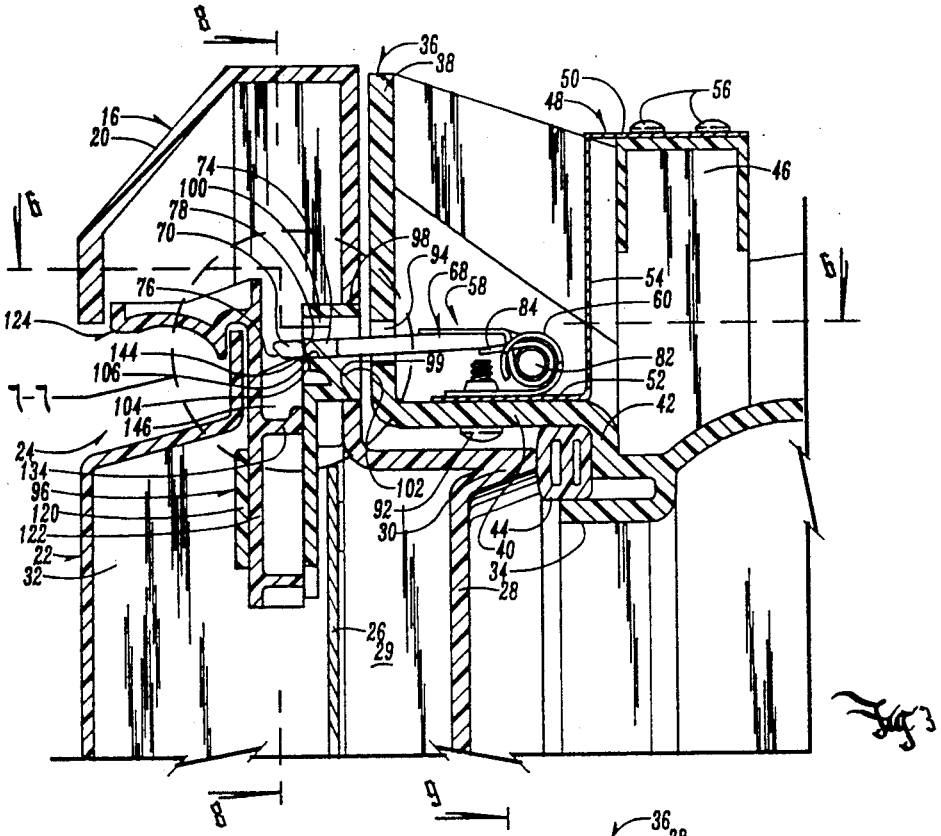
FIG. 3 is a sectional view of the door and latch assembly, showing the latch assembly in its latch position.
Figure 4:
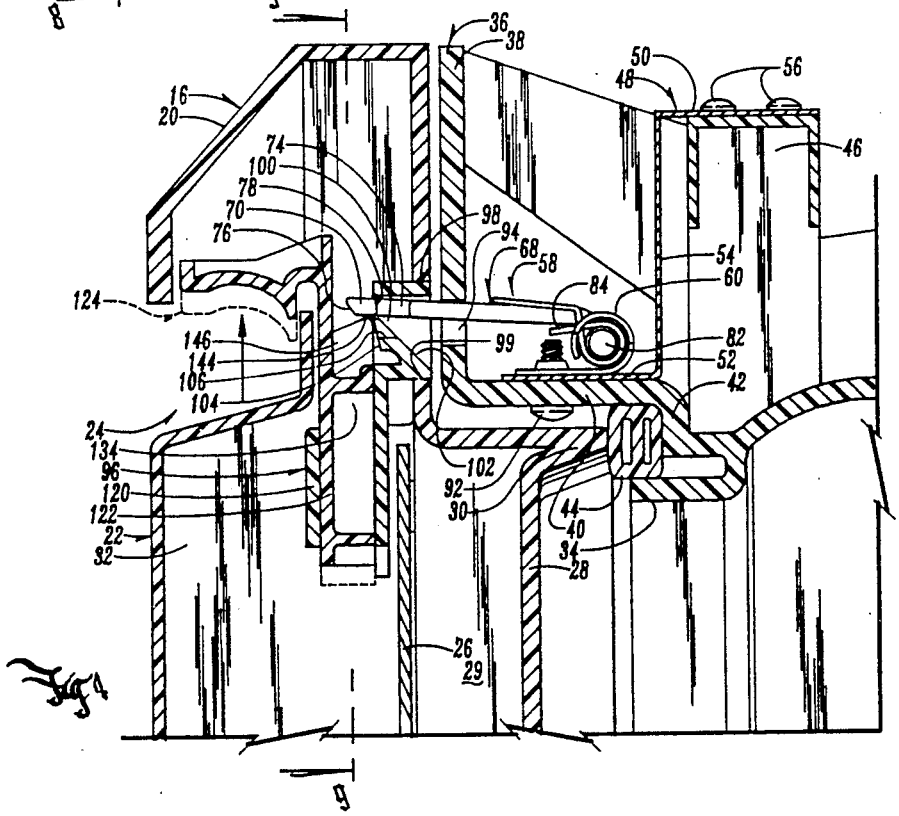
FIG. 4 is a view similar to FIG. 3, but showing the latch assembly in its intermediate position.
Figure 5:
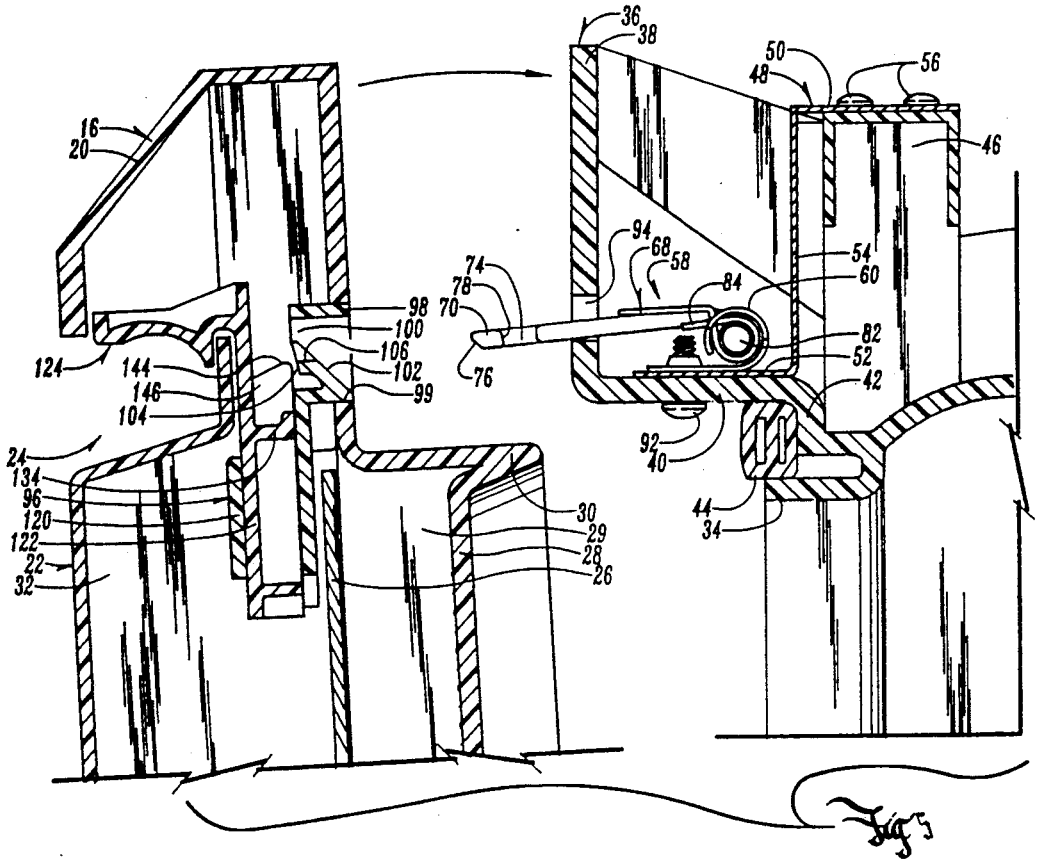
FIG. 5 is a view similar to FIG. 4, but showing the door unlatched.
Figure 6:
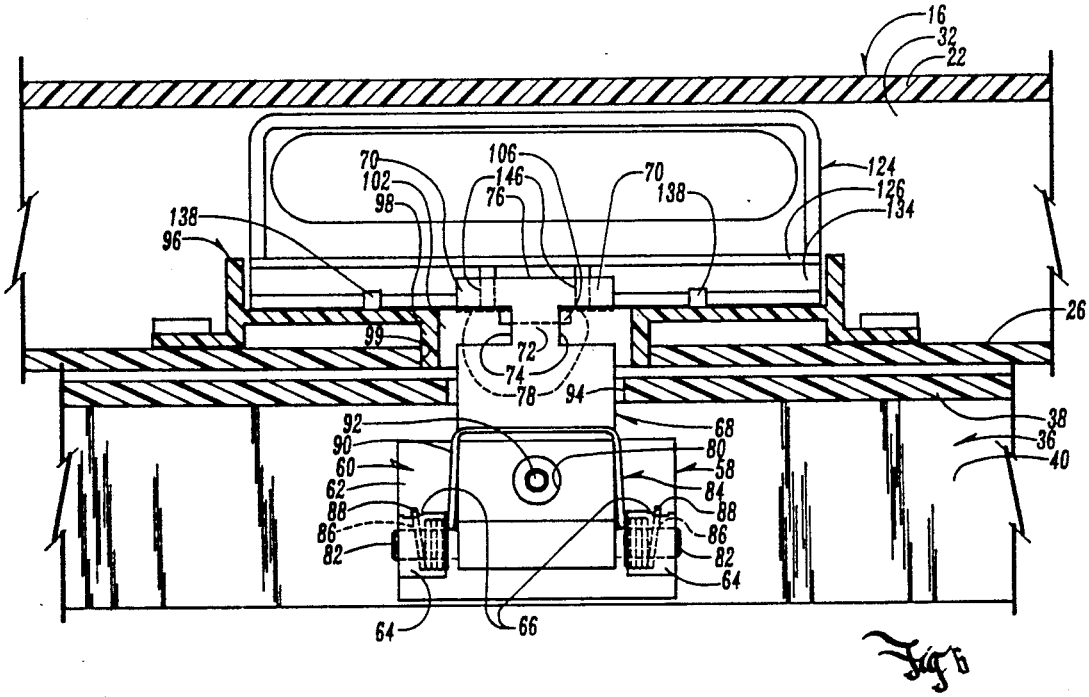
FIG. 6 is a sectional view taken along line 6—6 of FIG. 3.

Extending around the top and side walls of the dishwasher is a collar 46 which is shown in cross section in FIGS. 3-5. Mounted to collar 46 is a Z-bracket 48 having horizontal flanges 50, 52 which are interconnected by a vertical web 54. Rivets or bolts 56 secure the Z-bracket to the collar 46.

Mounted to the horizontal flange 52 of Z-bracket 48 is a strike assembly 58. Strike assembly 58 is shown in detail in FIGS. 2 and 2A, and includes a strike bracket 60, a strike member 68, and a torsion spring 84. Bracket 60 is comprised of a horizontal plate 62 having a pair of spaced apart curved sleeves 64 with notches 66 therein. Mounted to strike bracket 60 is strike member 68 which contains a T-shaped end formed by a T-cross bar 70 and a T-leg 72. On opposite sides of the T-leg 72 are a pair of notches 74. As can be seen in FIGS. 3-7, the T-cross bar 70 includes a first inclined edge 76 and a second inclined edge 78. A central hole 80 extends through the strike member 68, and a pair of oppositely extending pivot pins 82 extend outwardly from the strike member 68.

Strike member 68 is secured to strike bracket 60 by means of torsion spring 84 which includes a pair of coils 86, a pair of opposite ends 88, and an intermediate U-shaped portion 90 extending between the two coils.

Figure 2:
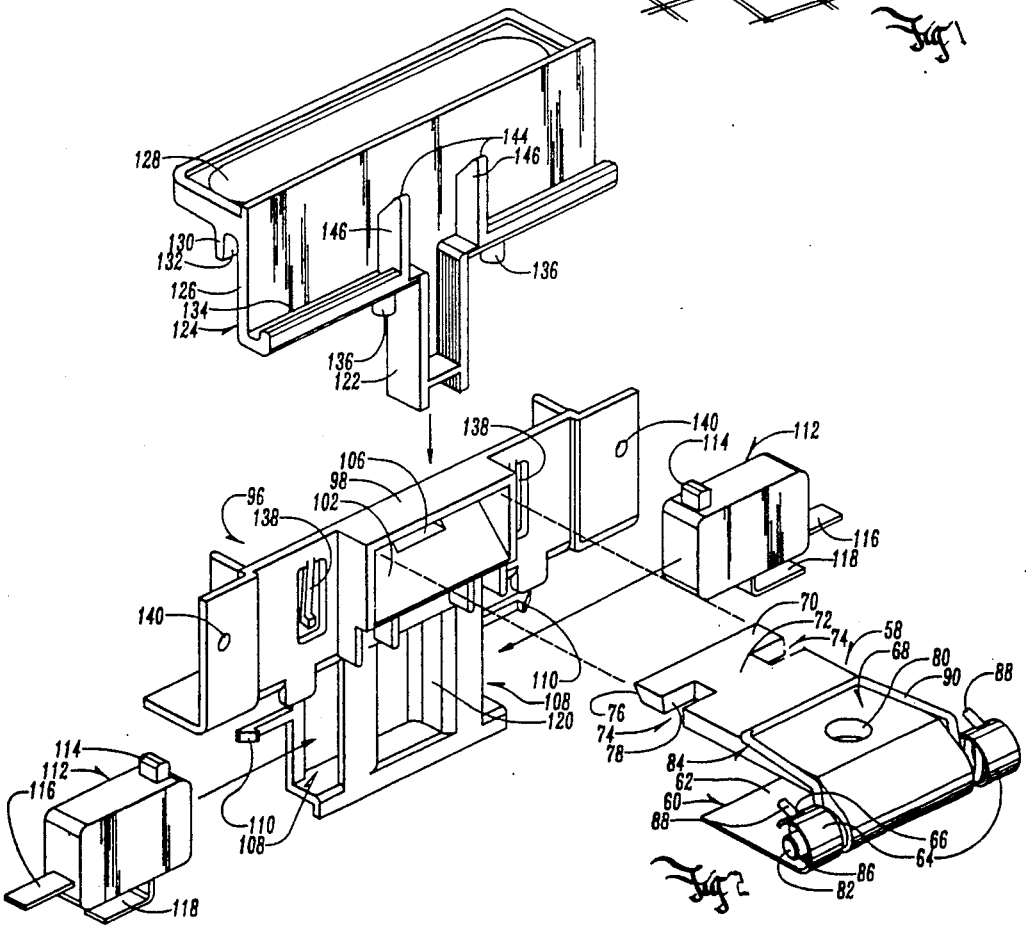
FIG. 2 is an exploded perspective view of the latch assembly of the present invention.
Figure 2A:
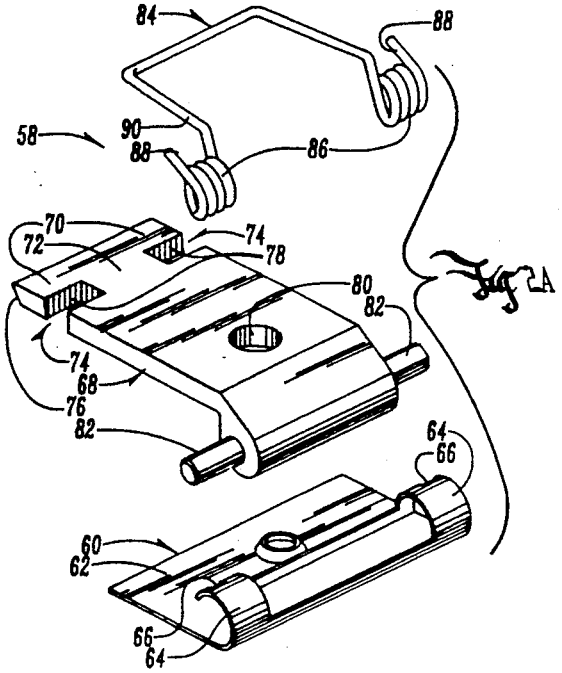
FIG. 2A is an exploded perspective view of the strike assembly, 58 of the present invention.

As can be seen in FIG. 2, the strike assembly 58 is mounted with the opposite ends 88 of spring 84 fitted within the notches 66 of curved sleeves 64. The pivot pins 82 of strike member 68 are fitted within the centers of coils 86 and within the sleeves 66. The U-shaped portion 90 of torsion spring 84 extends over the top of strike member 68. The resulting combination causes the strike member 68 to be pivotally mounted to the strike bracket 60 for pivotal movement about the axis formed by pins 82. The torsion spring 84 causes the strike member 68 to be yieldably urged in a counterclockwise direction (as viewed in FIG. 2) between a latch position shown in FIG. 3 and an unlatch position shown in FIGS. 4 and 5.

Strike assembly 58 is mounted to the door frame 36 and to the horizontal flange 52 of Z-bracket 48 by means of a mounting screw 92 as shown in FIGS. 3–5. The vertical flange 38 of door frame 36 includes an opening 94 through which strike member 68 extends.

Mounted within the controller compartment 32 is a bolt frame 96 (FIG. 2) which is preferrably molded from plastic. Bolt frame 96 includes a rectangularly shaped strike receptacle 98 having a T-shaped opening 100 (FIG. 2B) extending therethrough. A fixed bolt is formed by an inclined bolt ramp 102 and a latch shoulder 104. Within latch shoulder 104 is a centrally located notch 106.

Bolt frame 96 is also shaped to form a pair of switch receptacles 108 having switch snaps 110 adjacent thereto. Fitted within these receptacles 108 are a pair of switches 112 which are of conventional construction and which include a switch plunger 114 and a pair of electrical connectors 116, 118. These switches may vary according to design choice, but preferrably they are rated for at least 25 amperes. The switch snaps 110 hold the switches in place within switch receptacles 108.

Figure 11:
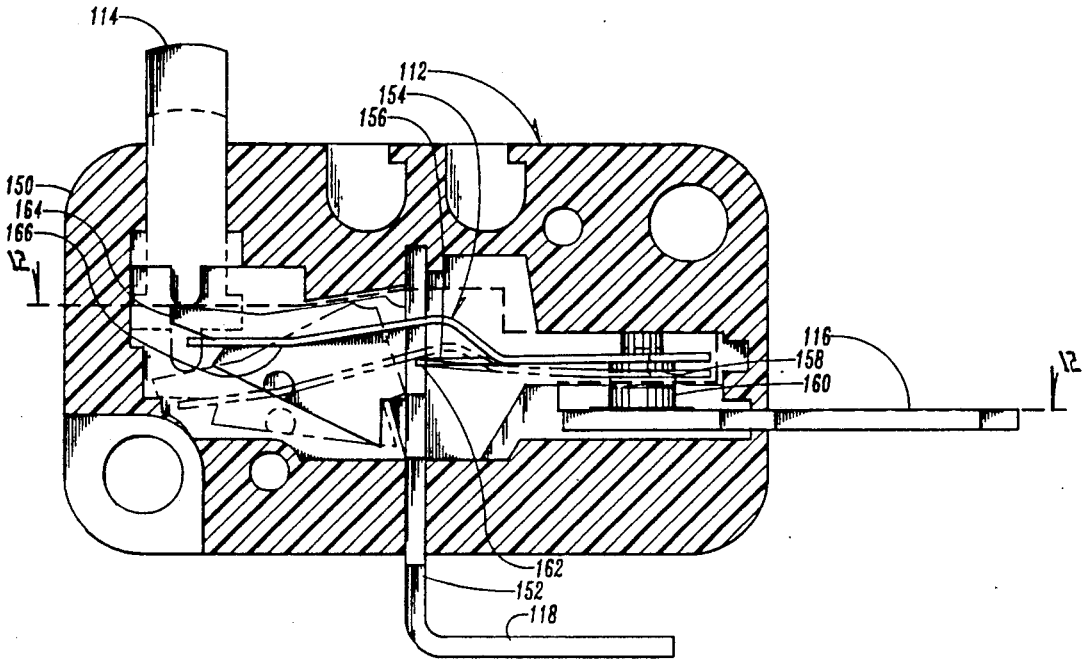
FIG. 11 is a sectional view showing the inside of one of the switches used in the present invention.
Figure 12:
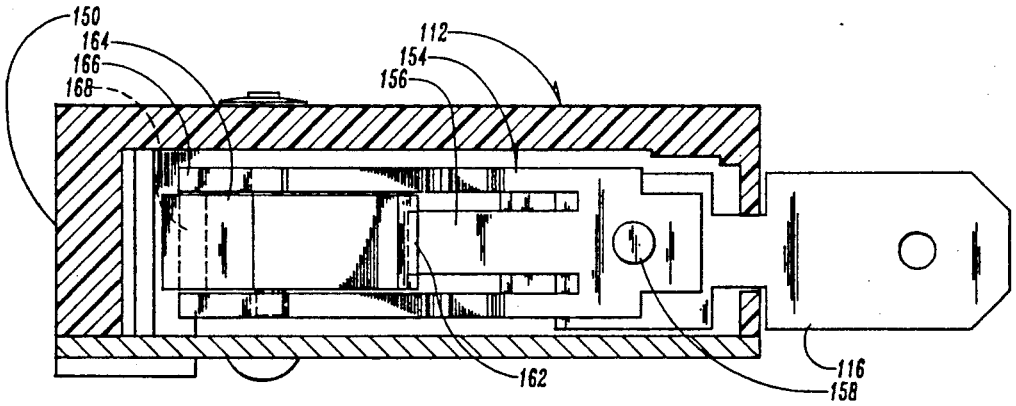
FIG. 12 is a sectional view taken along line 12—12 of FIG. 11.

The internal structure of switches 112 is shown in FIGS. 11 and 12. Each switch 112 comprises an outer housing 150. Within the housing 150 is a vertical leg 152 of connector 118. Surrounding leg 152 is a spring contact 154 having a central toggle member 156 with a contact point 158 adapted to engage a contact point 160 on the inner end of connector 116. The inner end of central toggle member 156 is fitted within a notch 162 in the vertical leg 152 of connector 118. A cam member 164 is fitted between two spaced apart spring arms 166 of spring contact 154 and fits in covering relation over a cross member 168 so that downward depression of switch plunger 114 causes downward movement of cam member 164 and also causes downward movement of spring arms 166. The spring arms 166 yieldably urge the cam member and the switch plunger 114 upwardly to their extreme upper most positions. However, continued downward movement of plunger 114 against the spring bias provided by spring arms 166 causes the toggle member 156 to be pushed over center so that contact 158 moves from its normal open position shown in FIG. 11 to a closed position (shown in shadow lines), wherein contact 158 engages contact 160 thereby completing the power circuit for the dishwasher. However, if downward pressure on plunger 114 is released, the spring arms 166 cause the cam 164 and the plunger 114 to again move to their upper most position thereby causing the contact 158 to be sprung upwardly out of contact with the contact 160. Thus, the contacts 158, 160 are normally in an open circuit condition, and are only closed when the plunger 114 is pressed downwardly against the bias provided by spring arms 166.

Figure 2B:
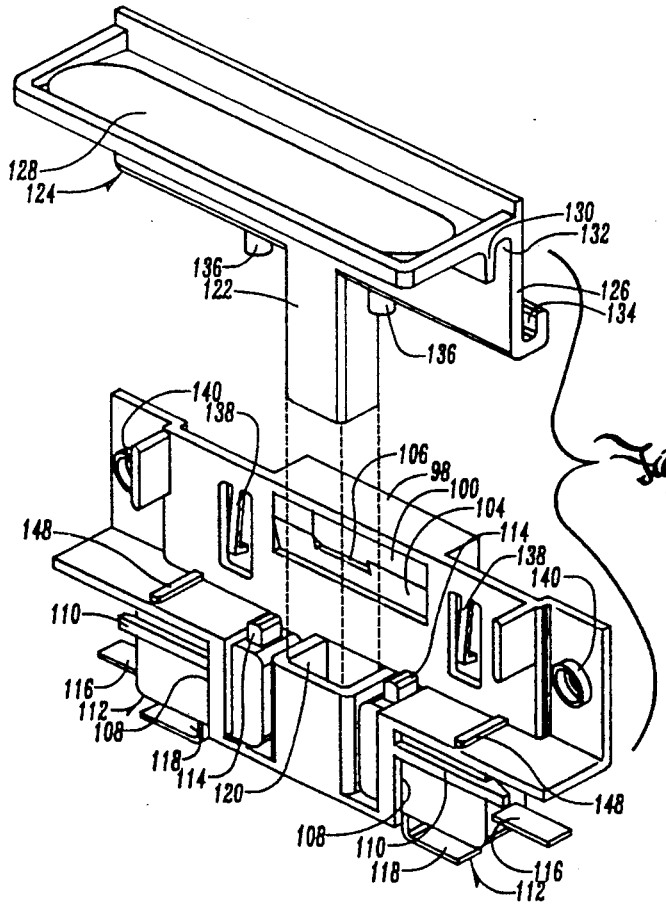
FIG. 2B is an exploded perspective view of the handle and the bolt frame, showing the opposite side from that shown in FIG. 2.

The outer most face of the bolt frame 96 is shown in FIG. 2B and includes a vertical guide collar 120 which is adapted to slidably receive a vertical guide channel 122 of an opening handle 124. Handle 124 comprises a vertical plate 126, a horizontal grasping flange 128, and a mounting flange 130 which forms a mounting channel 132 in combination with vertical plate 126. Extending along the lower edge of vertical plate 126 is a drainage channel 134, and protruding downwardly therefrom are a pair of spaced apart plunger stubs 136.

Figure 10:
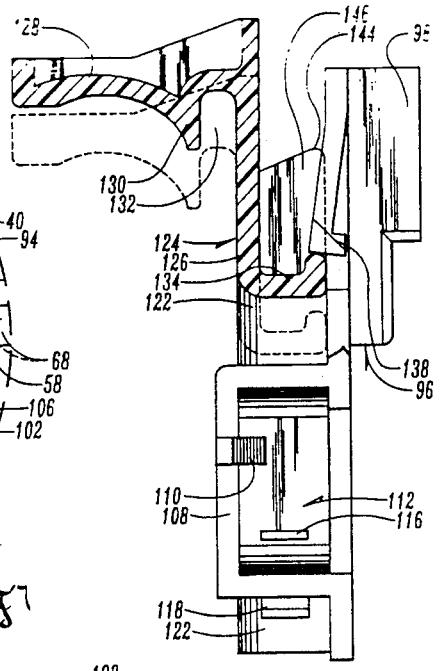
FIG. 10 is a sectional view taken along line 10—10 of FIG. 9.
Figure 8:
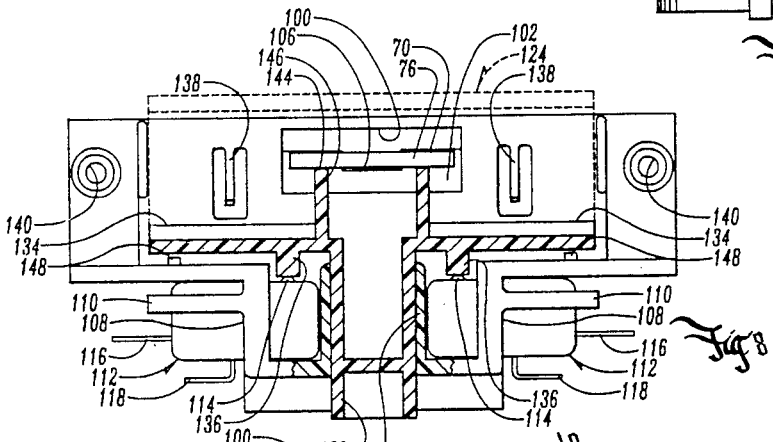
FIG. 8 is a sectional view taken along line 8—8 of FIG. 3.
Figure 9:
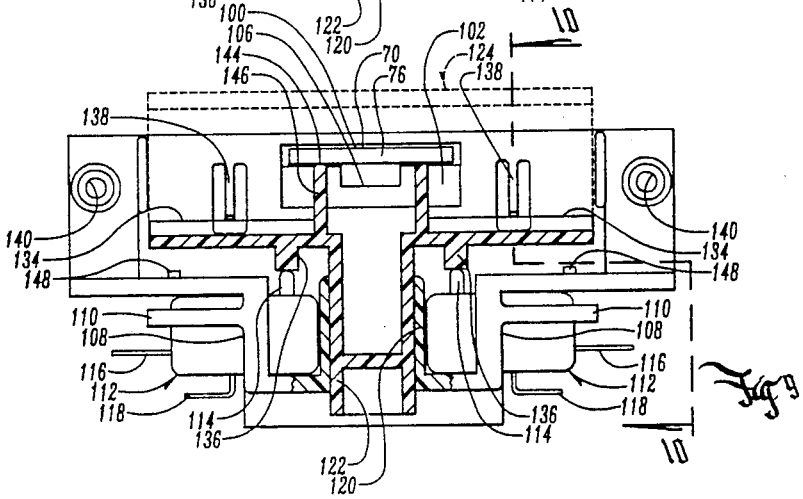
FIG. 9 is a sectional view taken along line 9—9 of FIG. 4.

Handle 124 is slidably mounted to bolt frame 96 by inserting channel 122 into the guide collar 120. As seen in FIG. 10, the handle snaps 138 in bolt frame 96 snap inwardly to provide a vertical limit to the sliding movement of handle 124 within the collar 120. The plunger stubs 136 of handle 124 are in registered alignment above switch plungers 114 as can be seen in FIGS. 8 and 9 so that movement of the handle from its upper position shown in FIG. 9 to its lower position shown in FIG. 8 causes the plunger stubs 136 to depress the switch plungers 114. Switches 112 are normally in an open position, and the plungers 114 are held in their upper most position by a plunger spring (not shown) which is within the switch 112. In this open position, the switches prevent actuation of the power circuit of the dishwasher. However, when the handle 124 is depressed from the position shown in FIG. 9 to the position shown in FIG. 8, it causes the plungers 114 to be depressed also, and changes the configuration of the switches to a closed circuit condition, thereby permitting actuation of the power circuit for the dishwasher.

Bolt frame 96 and handle 124 are secured together and then are mounted within the controller compartment 32 of door 16 as shown in FIGS. 3–5. In this position, the screw mounting holes 140 (FIG. 2) are used to receive bolts or screws (not shown) to mount the bolt assembly 96 in place. In this position, the strike receptacle 98 is matingly inserted within an opening 99 in the internal face of panel 28 of door 16.

Figure 13:
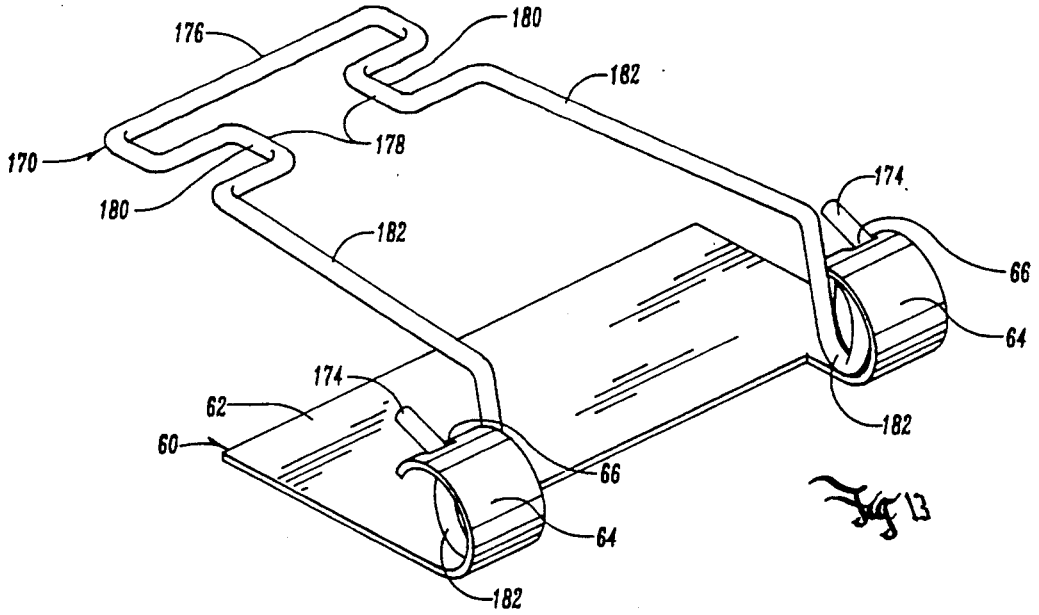
FIG. 13 is a perspective view of a modified form of the strike assembly of the present invention.

FIG. 13 illustrates a modified form of the strike member designated by the numeral 170. In this modified form 170, the strike member is made integral with the torsion spring rather than as a separate part as shown in FIG. 2. The strike member 170 comprises a pair of torsion spring coils 172 which have coil ends 174 fitted within the notches 66 of the curved sleeves 64. Extending upwardly from the spring coils 172 are a pair of side members 182 which are shaped at their outer end into a T-cross bar 176 having a T-leg 178 and having a pair of spaced apart notches 180. The T-cross bar 176 and the notches 180 are adapted to engage the inclined bolt ramp 102 and ultimately provide the same function as T-cross bar 70 and T-leg 72 of strike member 68 shown in FIG. 2.

The operation of the latch assembly is illustrated in FIGS. 3–5. FIG. 5 shows the door in an unlatch position. In this position, torsion spring 84 urges the outer most end of T-cross bar 70 to its lower most or latch position. As the door is closed, the first inclined edge 76 of strike member 68 encounters the bolt ramp 102 and cams upwardly. This causes the strike member 68 to be cammed up to its unlatch position shown in FIG. 4. Continued closing movement of the door causes the second inclined edge 78 of T-cross bar 70 to ride upwardly over latching shoulder 104, thereby permitting the strike member to pivot downwardly from its unlatch position shown in FIG. 4 to its latch position shown in FIG. 3. As can be seen in FIG. 3, the second inclined edge 78 of T-cross bar 70 engages the latch shoulder 104 which is inclined in the opposite direction so that the two cooperate together to cause a camming action therebetween urging the strike member downwardly to its extreme lower most latch position shown in FIG. 3. This downward movement is further helped by the yieldable force exerted by torsion spring 84.

Figure 7:
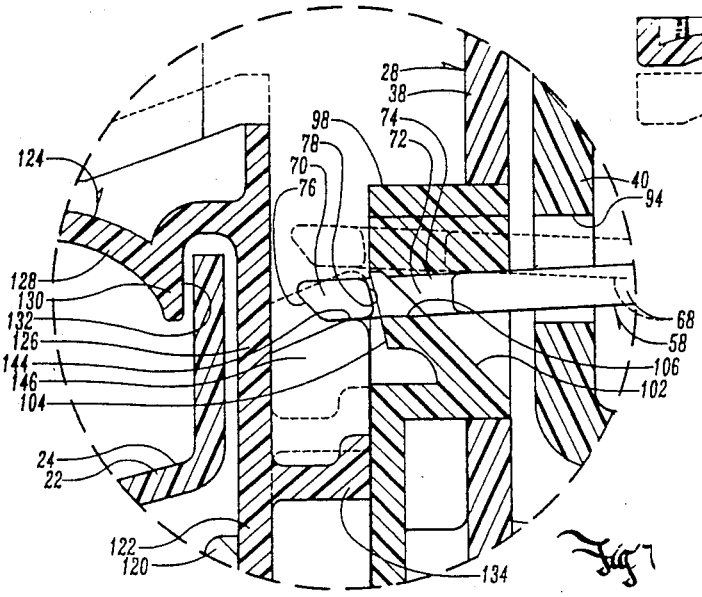
FIG. 7 is an enlarged sectional view taken along line 7—7 of FIG. 3.

As can be seen in FIGS. 3, 4, and 7, the T-cross bar 70 of strike member 68 also engages the upper edges 144 of a pair of vertical ribs 146 which are integrally formed with the handle 124. Thus, as the strike member moves from its unlatch position shown in FIG. 4 to its latch position shown in FIG. 3, it also urges the handle 124 downwardly from its upper most position to its lower most position, thereby simultaneously causing the depression of the switch plungers 114 from their extended position shown in FIG. 9 to their retracted position shown in FIG. 8. This causes the switches 112 to be placed in a closed condition, thereby actuating the power system of the dishwasher. From this construction, it can be seen that the power system of the dishwasher is only actuated when the door is in its latch position with the strike member 68 holding the handle 124 and the switch plungers 114 in their lower most position. Thus, the handle 124 and the plungers 114 provide an intermediary actuating mechanism for transferring motion from the strike member 68 to the switches 112 to actuate the switches.

When it is desired to open the door, the operator's hand engages the horizontal grasping flange 128 and urges it upwardly from the position shown in FIG. 3 to the position shown in FIG. 4. This causes lifting of the strike member 68 from its lower most latch position to its upper most unlatch position, and also lifts the plunger stubs 136 from the position shown in FIG. 8 to the position shown in FIG. 9, thereby permitting the plungers 114 to spring upwardly and changing the switches 112 to their open condition. Thus, before the door latch is released, the switches are turned to an open condition, and the power system for the dishwasher is shut off. Once the handle has been raised to the position shown in FIG. 4, the strike member is free to slide outwardly from the door to the position shown in FIG. 5 and the door may be open. In this condition, the strike member 68 again springs downwardly to its latch position as shown in FIG. 5.

Several important advantages are obtained with the present invention. The use of a torsion spring to urge the strike member 68 downwardly results in a nearly constant force being applied to the outer end 70 of the strike member throughout movement from its upper most unlatch position to its lower most latch position. Furthermore, a greater force can be applied by use of the torsion spring than can be achieved with other types of springs such as leaf springs. The force which can be applied has been found to be greater than two pounds which permits larger switches to be used since typically the larger the rating of the switch, the greater the spring resistance of the plungers 114. It has been found that switches having ratings as high as 25 amperes can be utilized with the present invention. Switches with 25 ampere ratings have spring mounted plungers which are overcome by the downward force exerted by the two pounds resulting from the use of the torsion spring.

An advantage is obtained by the utilization of a vertically slidable handle rather than a pivoted handle as in many prior devices. The vertical sliding movement of handle 124 minimizes the front to back space required within the controller compartment 32. Furthermore, a linear relationship is established between the force required to move the handle 124 from its upper most position to its lower most position. The force to distance ratio is approximately one to one.

The switches 112 are protected from inadvertent splashing of water or washing fluid into the T-shaped opening 100 of strike receptacle 98. This is achieved by use of the drainage channel 134 and handle 124 which diverts water outwardly away from the switches. Also, a pair of dams 148 are provided in bolt frame 96 (FIG. 2B) for preventing inadvertent flowing of water inwardly toward the switches 112.

The preferred embodiment of the invention has been set forth in the drawings and specification, and although specific terms are employed, these are used in a generic or descriptive sense only and are not used for purposes of limitation. Changes in the form and proportion of parts as well as in the substitution of equivalents are contemplated as circumstances may suggest or render expedient without departing from the spirit or scope of the invention as further defined in the following claims.

I claim:

1. An appliance door latch assembly for use with an appliance having a cabinet, a door frame including a door opening being provided in said cabinet, and a door hinged to said cabinet and movable from a closed position in covering relation over said door opening to an open position, said door having a latch edge which is positioned adjacent said door frame when said door is in said closed position, said latch assembly comprising:

a strike assembly comprising a strike member, a first mounting means, and a strike spring means, said strike member having a strike end;

said first mounting means mounting said strike assembly to said door frame for movement of said strike member between a latch position and an unlatch position;

said strike spring means yieldably urging said strike member to said latch position with a first yieldable force;

a bolt having a ramp surface and a latching shoulder;

at least one electrical switch having a deactuated condition and an actuated condition, said switch having a switch actuator means biased toward a first position for causing said switch to be in said deactuated condition, said switch actuator means being movable from said first position to a second position for causing said switch to be in said actuated condition;

second mounting means fixedly mounting said bolt and said switch to said door;

said switch actuator means comprising a switch member drivingly connected to said switch and an intermediate actuator member drivingly engaging said switch member;

said strike member being engagable with, and movable by said ramp surface of said bolt during movement of said door from said open position to said closed position for a first movement of said strike member from said latch position to said unlatch position and for a second movement of said strike member from said unlatch position to said latch position in retentive engagement with said latching shoulder of said bolt for holding said door in said closed position;

said strike member engaging said switch actuator means during said second movement of said strike member, said first yieldable force exerted by said spring means of said strike member being sufficient to cause said switch to be changed to said actuated condition only when said door is in said closed position;

said strike spring means being of a type that causes said first yieldable force exerted on said strike member to be approximately constant at said strike end throughout movement from said unlatch position to said latch position.

2. An appliance door latch assembly according to claim 1 wherein said strike member is integral with said strike spring means.

3. An appliance door latch assembly according to claim 1 wherein said first mounting means movably mounts said strike member to said door frame, said strike spring means engaging said strike member and urging said strike member toward said latch position.

4. An appliance door latch assembly according to claim 1 wherein said first mounting means pivotally mounts said strike member to said door frame for pivotal movement about a strike axis.

5. An appliance door latch assembly according to claim 4 wherein said strike member comprises a T-shaped end having a T-cross bar and a T-leg, said T-cross bar engaging said latch shoulder of said bolt after said second movement of said strike member to said latch position.

6. An appliance door latch assembly according to claim 5 wherein said T-cross bar engages said switch actuator means during said second movement of said strike member to said latch position.

7. An appliance door latch assembly according to claim 6 wherein said bolt further comprises a notch receiving said T-leg of said strike member when said T-cross bar engages said latching shoulder of said bolt.

8. An appliance door latch assembly according to claim 7 wherein said T-cross bar includes an inclined surface, said latching shoulder having a complimentary inclined surface engaging said inclined surface of said T-cross bar when said strike member is in said latch position and said door is closed, said inclined surface and said complimentary inclined surface cooperating when engaging one another to urge said strike member to said latch position in response to attempted movement of said door toward said open position.

9. An appliance door latch assembly according to claim 1 wherein a handle is connected to said switch actuator means for permitting manual movement of said switch actuator means to said first position and said strike member to said unlatch position for permitting opening of said door and changing of said switch to said deactuated condition.

10. An appliance door latch assembly according to claim 1 wherein said intermediate actuator member is interposed between said strike member and said switch member during said second movement of said strike member to said latch position, thereby transferring said second movement of said strike member to said switch member and causing said switch to be changed to said actuated condition.

11. An appliance door latch assembly according to claim 1 wherein said strike spring means comprises a torsion spring.

12. An appliance door latch assembly according to claim 1 wherein said strike spring means is of a type that causes said first yieldable force to have a magnitude of at least two pounds at said strike end, a switch bias means yieldably holding said switch actuating means in said first position with a second yieldable force less than said first yieldable force.

13. An appliance door latch assembly according to claim 12 wherein said electrical switch has an amperage rating of at least 25 amperes.

14. An appliance door latch assembly for use with an appliance having a cabinet, a door frame including a door opening being provided in said cabinet, and a door hinged to said cabinet and movable from a closed position in covering relation over said door opening to an open position, said door having a latch edge which is positioned adjacent said door frame when said door is in said closed position, said latch assembly comprising:

a strike member;

first mounting means movably mounting said strike member to said door frame for movement between a latch position and an unlatch position;

strike spring means exerting a first yieldable force on said strike member yieldably urging said strike member to said latch position;

a bolt having a ramp surface and a latching shoulder;

at least one electrical switch having a deactuated condition and an actuated condition;

switch actuator means drivingly engaging said switch and movable from a first position for causing said switch to be in said deactuated condition to a second position for causing said switch to be in said actuated condition;

second mounting means fixedly mounting said bolt and said switch to said door;

said strike member being engagable with, and movable by said ramp surface of said bolt during movement of said door from said open position to said closed position for a first movement of said strike member from said latch position to said unlatch position and for a second movement of said strike member from said unlatch position to said latch position in retentive engagement with said latching shoulder of said bolt for holding said door in said closed position;

said strike member engaging said switch actuator means during said second movement of said strike member to said latch position for causing said switch actuator means to move to said second position, whereby said switch actuator means will cause said switch to be changed to said actuated condition when said door is in said closed position;

said strike member comprising a T-shaped end having a T-cross bar and a T-leg, said T-cross bar engaging said latching shoulder of said bolt after said second movement of said strike member to said latch position.

15. An appliance door latch assembly according to claim 14 wherein said strike spring means is a torsion spring.

16. An appliance door latch assembly according to claim 14 wherein said T-cross bar engages said switch actuator means during said second movement of said strike member to said latch position.

17. An appliance door latch assembly according to claim 16 wherein said bolt further comprises a notch receiving said T-leg of said strike member when said T-cross bar engages said latching shoulder of said bolt.

18. An appliance door latch assembly according to claim 17 wherein said T-bar includes an inclined surface, said latching shoulder having a complimentary inclined surface engaging said inclined surface of said T-cross bar when said strike member is in said latch position and said door is closed, said inclined surface and said complimentary inclined surface cooperating when engaging one another to urge said strike member to said latch position in response to attempted movement of said door toward said open position.

19. An appliance door latch assembly according to claim 14 wherein a handle is connected to said switch actuator means for permitting manual movement of said switch actuator means to said first position and said strike member to said unlatch position for permitting opening of said door and changing of said switch to said deactuated condition.

20. An appliance door latch assembly according to claim 14 wherein said switch actuator means comprises a switch member drivingly connected to said switch and an intermediate actuator member drivingly engaging said switch member.

21. An appliance door latch assembly according to claim 14 wherein said strike spring means comprises a torsion spring.

22. An appliance door latch assembly according to claim 20 wherein said strike member engages said intermediate actuator member during said second movement of said strike member to said latch position.

23. An appliance door latch assembly for use with an appliance having a cabinet, a door frame including a door opening being provided in said cabinet, and a door hinged to said cabinet and movable from a closed ,/ position in covering relation over said door opening to an open position, said door having a latch edge which is positioned adjacent said door frame when said door is in said closed position, said latch assembly comprising:

a strike member;

first mounting means movably mounting said strike member to said door frame for movement between a latch position and an unlatch position;

strike spring means exerting a first yieldable force on said strike member yieldably urging said strike member to said latch position;

a bolt having a ramp surface and a latching shoulder;

at least one electrical switch having a deactuated condition and an actuated condition;

switch actuator means engagable with said switch and movable from a first position for causing said switch to be in said deactuated condition to a second position for causing said switch to be in said actuated condition;

second mounting means fixedly mounting said bolt and said switch to said door;

said strike member being engagable with, and movable by said ramp surface of said bolt during movement of said door from said open position to said closed position for a first movement of said strike member from said latch position to said unlatch position and for a second movement of said strike member from said unlatch position to said latch position in retentive engagement with said latching shoulder of said bolt for holding said door in said closed position;

said strike member engaging said switch actuator means during said second movement of said strike member, said first yieldable force exerted by said spring means of said strike member being sufficient to cause said switch actuator means to move to said second position, whereby said switch actuator means will cause said switch to be changed to said actuated condition when said door is in said closed position;

said switch actuator means comprising a switch member drivingly connected to said switch for causing said switch to change to said actuated condition in response to said second movement of said strike member to said latch position;

said switch actuator means further comprising an intermediate actuator member movably mounted to said second mounting means and being interposed between said strike member and said switch member during said second movement of said strike member to said latch position.

24. An appliance door latch assembly according to claim 23 wherein said second mounting means includes guide means slidably mounting said intermediate actuator member thereto for sliding vertical movement in response to said second movement of said strike member to said latch position.

25. An appliance door latch assembly according to claim 23 wherein said intermediate actuator member includes a first switch shield means and said second mounting means includes second switch shield means, said first and second switch shield means cooperating to provide a fluid barrier between said switch and said strike member whenever said strike member is in said latch position.

26. An appliance door latch assembly according to claim 23 wherein said intermediate actuator member includes a fluid run-off channel for redirecting any fluid coming from the direction of said strike member to prevent fluid from engaging said switch.

27. An appliance door latch assembly according to claim 23 wherein switch bias means yieldably hold said switch actuator means in said first position.

28. An appliance door latch assembly for use with an appliance having a cabinet, a door frame including a door opening being provided in said cabinet, and a door hinged to said cabinet and movable from a closed position, said door frame when said door is in said closed position, said latch assembly comprising:

a strike assembly comprising a strike member, a first mounting means, and a strike spring means, said strike member having a strike end;

said first mounting means mounting said strike assembly to said door frame for movement of said strike member between a latch position and an unlatch position;

said strike spring means yieldably urging said strike member to said latch position with a first yieldable force;

a bolt having a ramp surface and a latching shoulder;

at least one electrical switch means mounted to said door and being movable between an actuated and a deactuated condition;

second mounting means mounting said bolt and said switch means to said door;

switch bias means yieldably urging said switch means toward said deactuated position with a second yieldable force less than said first yieldable force of said strike spring means;

handle means movably mounted to said door for linear movement between a release position and a secured position;

said strike member being engagable with, and movable by said ramp surface of said bolt during movement of said door from said open position to said closed position for a first movement of said strike member from said latch position to said unlatch position and for a second movement of said strike member from said unlatch position to said latch position in retentive engagement with said latching shoulder of said bolt for holding said door in said closed position;

said switch means being movable from said deactuated position to said actuated position in response to said second movement of said strike member to said latch position when said door is in said closed position;

said handle means being movable from said release position to said secured position in response to said second movement of said strike member to said latch position;

said handle means engaging said strike member when said strike member is in said latch position and being manually linearly movable from said secured position to said release position for causing said strike member to move from said latch position to said switch bias means will cause said switch means to move from said deactuated position to said actuated position.

29. An appliance door latch assembly according to claim 28 and further comprising guide means movably mounting said handle means to said door and guiding said handle means in a linear path during movement of said handle means between said release and secured positions.

30. An appliance door latch assembly according to claim 28 wherein said handle means includes an intermediate portion interposed between said strike member and said switch means during said second movement of said strike member for transferring movement of said strike member to said switch means.

* * * * *

UNITED STATES PATENT AND TRADEMARK OFFICE

CERTIFICATE OF CORRECTION

PATENT NO. : 5,174,618

DATED : December 29, 1992

INVENTOR(S) : Keith E. Kropf

It is certified that error appears in the above-identified patent and that said Letters Patent is hereby corrected as shown below:

| | | |
|---|---|---|
| Col. 12, Claim 28 line 33 | Claim 30, line 4 | after "tion" delete -- , -- and insert -- in covering relation over said door opening to an open position, said door having a latch edge which is positioned adjacent -- |

Signed and Sealed this

Fourth Day of January, 1994

Bruce Lehman

*Attest:*

BRUCE LEHMAN

*Attesting Officer*

*Commissioner of Patents and Trademarks*